United States Patent [19]

Arasmith

[11] Patent Number: 4,697,626

[45] Date of Patent: Oct. 6, 1987

[54] LOG CHIPPING AND FLAKING APPARATUS AND METHOD

[76] Inventor: Stanley D. Arasmith, 5146 Big Texas Valley Rd., Rome, Ga. 30164

[21] Appl. No.: 917,999

[22] Filed: Oct. 14, 1986

[51] Int. Cl.[4] ..... B27L 11/00

[52] U.S. Cl. ..... 144/373; 144/208 G; 144/375

[58] Field of Search ..... 144/172, 174, 162 R, 144/208 R, 208 G, 369, 370, 373, 375

[56] References Cited

U.S. PATENT DOCUMENTS

| | | | |
|---|---|---|---|
| 242,138 | 5/1881 | King . | |
| 1,438,651 | 12/1922 | Jones | 144/236 |
| 1,456,328 | 5/1923 | Moravec . | |
| 1,619,151 | 3/1927 | Moravec . | |
| 2,880,859 | 6/1959 | Johnson | 144/176 |
| 2,891,588 | 6/1959 | Allen | 144/208 |
| 2,951,518 | 9/1960 | Cumpston, Jr. | 144/172 |
| 3,219,076 | 11/1965 | Logan | 144/42 |
| 3,267,976 | 8/1966 | Keeney | 144/208 |
| 3,285,305 | 11/1966 | Nicholson | 144/208 |
| 3,304,970 | 2/1967 | Altosaar | 144/162 |
| 3,324,909 | 6/1967 | McCranie | 144/326 |
| 3,394,744 | 7/1968 | Vit | 144/326 |
| 3,732,907 | 5/1973 | Nystrom | 144/176 |
| 3,746,062 | 7/1973 | Nystrom | 144/176 |
| 3,884,281 | 5/1975 | Pease | 144/374 |
| 3,986,543 | 10/1976 | Slayton et al. | 144/236 |
| 4,444,234 | 4/1984 | Arasmith | 144/174 |

OTHER PUBLICATIONS

"The Logger and Lumberman", Jul. 1986, p. 46, advertisement in left column for M-K's Rotary Hog: Rugged Rotary Sheer Action with Inertial Energy.

*Primary Examiner*—W. D. Bray

*Attorney, Agent, or Firm*—Jones, Askew & Lunsford

[57] ABSTRACT

A wood processing machine includes a cylindrical cutter assembly having a plurality of adjacent disks, each holding one or more cutting blades. The cutting blades are mounted in indentations in the disks. The solid character of the cylindrical structure thus formed can be smaller than prior drum-type wood processors because the individual disks are stronger than the thin plate of a drum. The novel disk construction is shown utilized in a wood chipping apparatus and in a wood flaking apparatus.

15 Claims, 10 Drawing Figures

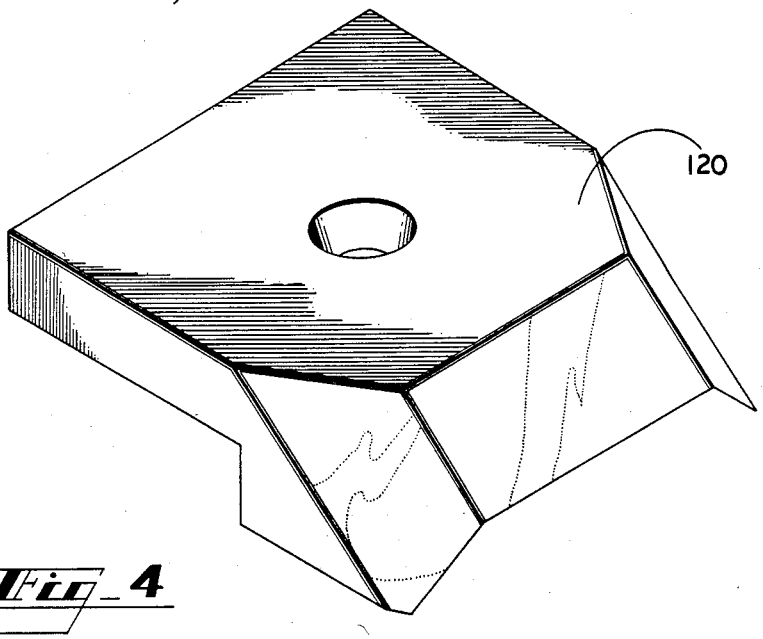
Fig. 4
Fig. 3
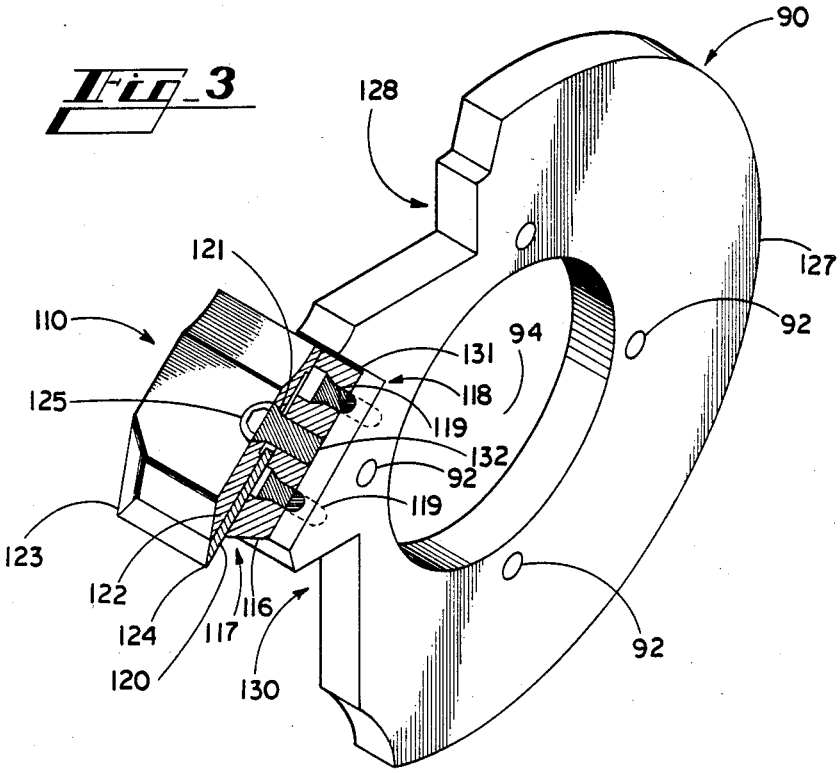

LOG CHIPPING AND FLAKING APPARATUS AND METHOD

TECHNICAL FIELD

The present invention relates to apparatus for processing newly harvested logs prior to further processing into finished products, and more particularly relates to an apparatus for debarking, rounding, sizing and chipping and flaking logs.

BACKGROUND ART

When logs are harvested from the forest, the logs are used in many processes. Particular logs may be bound for lumber mills, pulp mills, plywood mills or veneer mills. Many logs are crooked, oversized or have irregularities that make them unsuitable for use in such processes. Bark must be removed before precision chips are produced and before a log can be processed by a veneer lathe. Logs must be uniformly round for the production of usable veneer in a veneer lathe, and can be more efficiently packed in shipping containers or vats for soaking and steaming the logs is the logs are round. Round logs are also required for certain end uses such as posts or poles. In addition, one may desire to process a log into very thin flakes. The very thin wood flakes are used to manufacture chip boards or flake boards.

In the past, the debarking, rounding, sizing and chipping operations have generally been carried out on separate machines. This practice has been inefficient in terms of energy use, time and labor.

Prior debarking apparatus has included ring-type debarkers like that shown in U.S. Pat. No. 3,285,305. In such machines a log passes through a ring fitted with scrapers that rotate around the log rapidly and remove the bark as the log passes through the ring. A disadvantage of the ring-type debarkers is that the diameter of the ring restricts the maximum size log that can be processed. The process is time consuming because the scrapers do not work along the entire length of the log simultaneously. Also, the log handling apparatus provided with ring debarkers often cannot handle logs under a certain length.

Another type of debarker is the slitter disc, as shown in U.S. Pat. No. 2,891,588. Debarking has also been accomplished by rossing and abrading rollers, as shown in U.S. Pat. No. 1,619,151, by tossing a number of logs inside a drum having scrapers or abrading heads mounted on the interior wall of the drum, and by machines which remove the bark by causing a rossing or abrading head to traverse the length of the log back and forth as the log is slowly rotated.

Rounding of crooked logs and reducing their diameter to a size acceptable in further processing steps has been accomplished using a veneer lathe. It has been necessary in the prior art devices to pre-center the log in a lathe charger by engaging the opposite ends of the log with spindles or the like, and placing the log into the veneer lathe to remove radially protruding portions from the log so that it will be round in shape prior to the actual removal of usable veneer sheets. It can be difficult to accurately center or locate the axis of the log when engaging the ends thereof, and therefore excessive amounts of wood may be removed by the lathe in attempting to shape the log before the veneer sheets can be cut. Furthermore, during this process the knife of the veneer lathe engages the entire length of the log, and therefore requires large amounts of energy to remove waste material from the log.

Many prior art devices have been developed for reducing logs to chips. A widely used device propels the log end-on at angle into a rotating disk upon the face of which are mounted cutter knives. Examples of such devices as shown in U.S. Pat. Nos. 3,732,907 and 3,746,062. Logs have also been propelled against cutter knives protruding from the exterior of rotary drums, both end-on, as shown in U.S. Pat. Nos. 3,285,305; 3,304,970; and 3,394,744, or along the length of a log, as shown in U.S. Pat. No. 2,951,518. Yet another type of chipping apparatus provides a rotating head which chips away the side of the log as the log moves longitudinally past the head, as shown in U.S. Pat. Nos. 2,889,859 and 3,240,245. A disadvantage common to all such prior chippers is that the cutter knives traverse long paths through the logs. Thus, the devices have large horsepower requirements to provide the cutter knives with sufficient surge and force to carry them through the log. In most prior chippers, the cutter knives must, at some point in the consumption of the log, traverse the full diameter of the log. A further typical disadvantage of prior art debarkers, chippers, flakers and rounding apparatus is a necessity for complex and expensive log handling equipment required to guide the logs into engagement with the operative cutting or abrading elements, and to remove the processed log or chips therefrom. The nature of the handling apparatus or the operative cutting abrading elements often limits the maximum diameter of the logs that can be processed. Cutter knives which must make long cuts each time they engage the wood have relatively short lives and must be repeatedly replaced. Thus, there has been a need in the art for an apparatus capable of efficiently debarking, rounding, sizing and chipping logs harvested from the forest.

One prior device that attempts to alleviate some of the problems described above is disclosed in U.S. Pat. No. 4,444,234. This device is capable of debarking, rounding and chipping the log in one operation. The device has a large rotating cylinder with a plurality of knives on the periphery of the cylinder. The log is introduced into the apparatus and horizontally engages the cylinder. Although the apparatus described in the U.S. Pat. No. 4,444,234 will debark, round, and chip a log in one operation, the replacement of a knife in the cylinder is cumbersome and difficult. Another problem is that the cylinder must be of a certain diameter to provide sufficient structure between the adjacent knives. If the drum material between knives is insufficient, the drum could warp during operation.

Conventional wood flakers use the surface of the knife holder to gauge the depth of the cut. This causes a stability problem since the log tends to bounce against the surface of the knife holder. The resulting vibration causes the knife edge to dull more quickly, and may cause the wood flakes to vary in thickness. Wood flakes that vary in thickness can be unacceptable for many industrial purposes.

SUMMARY OF THE INVENTION

The present invention solves the problems with the prior art machines by providing a cylindrical cutter assembly comprising a plurality of discs, each disc holding one or more blades. In this way, the diameter of the cylinder that is defined by the plurality of discs can be much smaller since the combination of individual bladeholding discs is much stronger than relatively thin cylindrical plate of a drum as used in the past.

The cylindrical cutter assembly of the present invention can be easily repaired. If a disc is damaged, it can be removed and replaced without replacing or repairing the entire blade-supporting structure. Down-time would thereby be reduced. When a knife needs sharpening or needs to be replaced, the operator has the option of sharpening the knife as in the past or removing the one disc that holds the knife that needs repairing. The latter procedure could be more efficient for replacing multiple dull knives all mounted on a single disc.

One embodiment of the present invention provides a log processing apparatus that can provide a cost efficient means of debarking, rounding and chipping a log. In addition, a second embodiment of the present invention provides a log flaker.

The wood processing apparatus of the present invention provides rotary knife means and means for continuously changing the orientation of wooden members being processed by the knife means such that the path of travel of the knife means through the wooden member is maintained below a desirable length. This results in significant energy savings by reducing horsepower requirements without sacrifice of production speed.

Somewhat more particularly described, the present invention is a cylindrical cutter assembly comprising a plurality of discs mounted on a horizontal axis. The cylindrical cutter assembly of the present invention includes one or more cutters arrayed along the periphery of each disc. The plurality of cutters extend outwardly from the disc periphery. The apparatus includes a means for rotating the discs about the longitudinal axis.

In one embodiment of the present invention, the apparatus is a log chipper wherein there is a plurality of toothed rollers positioned beside the discs such that the periphery of the toothed rollers and the disc peripheries define a log-receiving cradle therebetween.

The toothed wheels can be mounted adjacent to the cylindrical cutter assembly along a driven shaft. Further apparatus is provided to permit the driven shaft and tooth wheels to be positioned to provide a long receiving cradle between the toothed wheels and the cylindrical cutter assembly, and to be selectively dropped with respect to the cylindrical cutter assembly to discharge the logs after processing. Means can be provided for varying the speed of rotation of the driven shaft and therefore to vary the speed of rotation of the log with respect to the speed of the cutter knives on the cylindrical cutter assembly. The chip collection means can be provided with a gate valve operable to direct bark removed from a log into one collection area and chips removed from the log into another collection area. The cutter knives are preferably helically arrayed about the surface of the cylindrical cutter assembly, and overlap axially along the cylindrical cutter assembly so that the material can be removed from the entire surface of a log in one rotation thereof. The amount of material removed during a single rotation can be adjusted by adjusting the speed of rotation of the log as compared to the speed of rotation of the cylindrical cutter assembly.

In another embodiment of the invention, the log processing apparatus of the present invention comprises a horizontally disposed cylindrical member. The cylindrical member is comprised of a plurality of discs, each disc containing one or two cutters. The cutters are arrayed helically along the length of the cylindrical member, each cutter extending outwardly from the surface of the cylinder. The log processing apparatus also comprises a means for rotating the cylindrical member about its longitudinal axis; and means engaging the circumferential surface of a log for guiding the log against the cylindrical member along essentially the entire length of the log, such means comprising a first roller means rotatable about an axis extending parallel to the longitudinal axis of the cylindrical member and below the horizontal plane thereof; second roller means rotatable about a movable axis extending parallel to the longitudinal axis of the cylindrical member at a greater distance than the axis of the first roller means, the second roller means being linked to the first roller means so as to be movable in an arcuate path about the axis of the first roller means; means for rotating the first and second roller means in synchronization so as to cause a log engaging the roller means to rotate at a controlled speed slower than the cylindrical member; and means for selectively moving the second roller means in an arcuate path about the axis of the first roller means, upwardly to urge the log against the cylindrical member, and downwardly to discharge the log.

This embodiment of the invention is particularly useful in rounding logs which are larger toward one end of the log than at the other end, because the log tends to rest upon the first roller means while the second roller means urges the larger diameter portion of the log into the cutters prior to substantial engagement of the thinner end with the cutter. Like the first embodiment of the invention generally described above, the second embodiment requires relatively non-complex log infeed and discharge apparatus and chip collection means. It will also be noted that the embodiments of the present invention can accept all logs without restriction as to their diameter, require lower horsepower than prior devices, and extend the lifetime of cutter knives utilized in accordance with the present invention.

In another embodiment of the present invention, the apparatus is a log flaker comprising a flaking head. The flaking head includes a plurality of discs mounted on a horizontal longitudinal axis and a plurality of cutters arrayed along the periphery of the discs and extending outwardly from the disc periphery. A means for rotating the flaking head is provided as well as a means for guiding the flaking head toward the log at a controlled speed. The surface of the flaking head thus is not used as a stop for determining the depth of cut, and this allows the cutters to stay sharp for a longer period of use.

In yet another embodiment of the present invention, the apparatus is a log flaker comprising a dual flaking head. The flaking head comprises a first cylindrical member and a second cylindrical member, each of the cylindrical members including a plurality of discs mounted on a horizontal longitudinal axis. Each of the cylindrical members include a plurality of cutters arrayed along the periphery of the discs and extending outwardly from the disc periphery. The first cylindrical member is mounted substantially adjacent to the second cylindrical member. The log flaker includes a means for rotating the cylindrical members about their longitudinal axis, the first cylindrical member rotating in a first direction and the second cylindrical member rotating in a second and opposite direction, and a means for guiding the cylindrical members toward the log at a controlled speed.

It will thus be seen that the present invention also provides a method of removing material from the exterior surface of the log, comprising the steps of guiding the log into longitudinal engagement with a cylindrical member including a plurality of discs mounted on a horizontal longitudinal axis and including a plurality of cutters arrayed along the periphery of the discs and extending outwardly from said disc periphery, rotating the discs about the longitudinal axis such that the cutters engage the log and remove material therefrom; and rotating the log about its longitudinal axis at a controlled speed. The log is preferably rotated in a direction opposite to the direction of the cylindrical member, at a speed less than the cylindrical member.

It will also be seen that the present invention also provides a method of removing flakes from the exterior surface of the log comprising the steps of guiding into the log at a controlled speed a flaking head, the flaking head comprising a first cutter assembly and a second cutter assembly, each of the cutter assemblies including a plurality of discs mounted on a horizontal longitudinal axis and including a plurality of cutters arrayed along the periphery of the discs and extending outwardly from the disc periphery; the first cutter assembly mounted substantially adjacent to the second cutter assembly, rotating the cutter assemblies about their longitudinal axis, the first cutter assembly rotating in a first direction and the second cutter assembly rotating in a second and opposite direction. The two cutter assemblies are guided toward the log in a controlled manner so that the blades cut very thin flakes off the log.

Thus, it is an object of the present invention to provide an improved apparatus for processing logs harvested from the first prior to further processing such logs in lumber, pulp, plywood, veneer or chip board mills.

A further object of the present invention is to provide a wood processing method and apparatus capable of debarking, rounding and sizing logs in a single operation.

A further object of the present invention is to provide a wood processing apparatus capable of either debarking and rounding logs or reducing such logs to wood chips.

A further object of the present invention is to provide a wood processing apparatus capable of reducing logs to thin wood flakes suitable for use in the chip board industry.

A further object of the present invention is to provide a debarking, rounding and chipping apparatus which processes logs quickly, yet has low horsepower requirements.

Yet another object of the present invention is to provide a debarking, sizing and chipping apparatus operable so as to extend the life of cutter knives utilized in the apparatus.

A further object of the present invention is to provide a debarking, sizing and chipping apparatus which has no upper limit on the diameter of logs that can be processed by the apparatus.

A further object of the present invention is to provide a log processing apparatus than can debark and size a log, and selectively provide the log with a smooth or a patterned surface.

Yet another object of the present invention is to provide a log processing apparatus that can remove material from the entire surface of a log in one revolution of the log.

A further object of the present invention is to provide a log processing apparatus that has knives mounted on individual discs so that the knives can be more easily removed and repaired or sharpened.

Other objects, features and advantages of the present invention will become apparent upon reading the following detailed description of embodiments of the invention, when taken in conjunction with the drawing and the appended claims.

BRIEF DESCRIPTION OF THE DRAWING

FIG. 3 is a perspective view of a cutting disc with a sectional view of one knife utilized in the cutter assembly of FIG. 1.

FIG. 4 is a perspective view of the knife utilized in the present invention.

DETAILED DESCRIPTION OF THE DISCLOSED EMBODIMENTS

Figure 1:
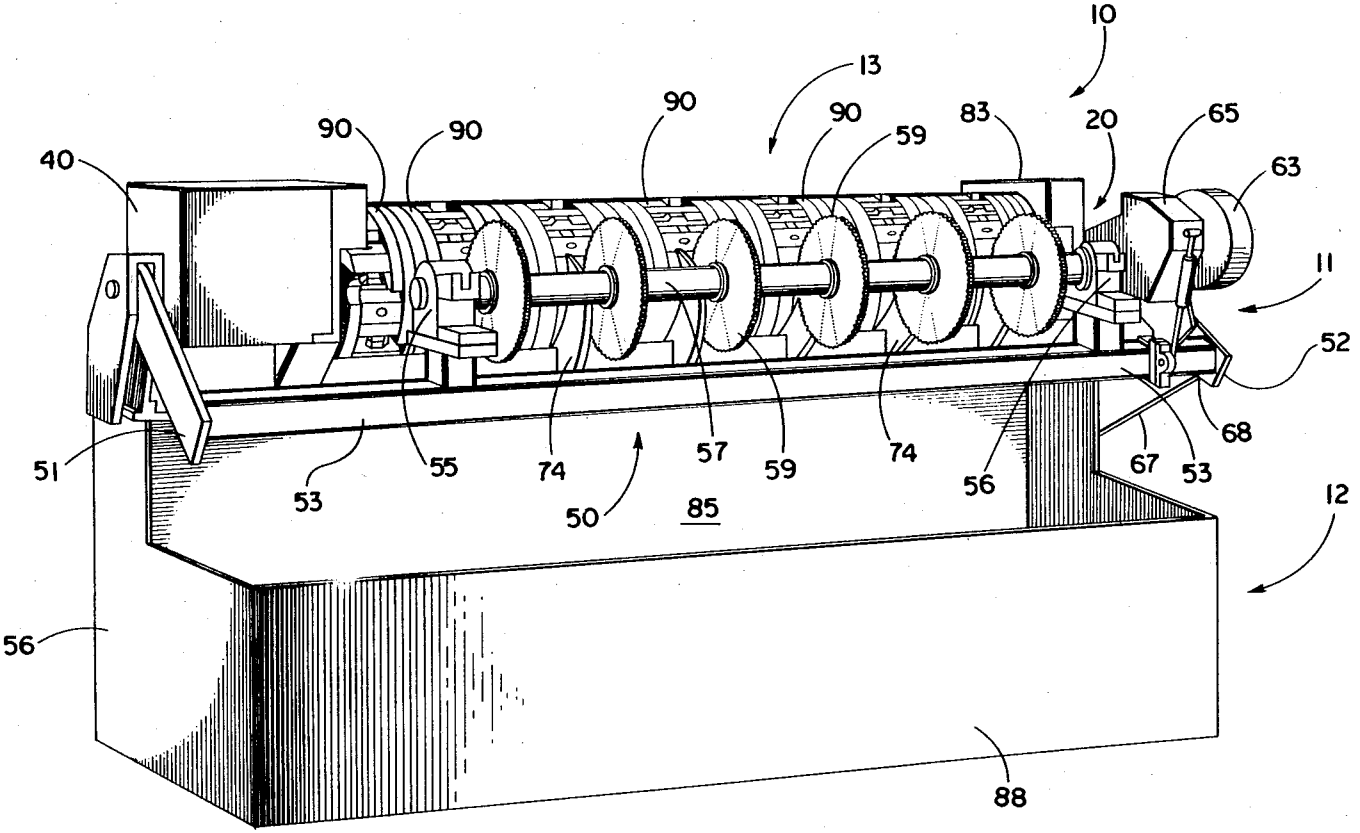
FIG. 1 is a front perspective view of the log processing apparatus of the present invention.

Referring now in more detail to the drawings, in which like reference numerals refer to like parts throughout the several views, FIG. 1 shows a log processing apparatus 10 embodying the present invention. The log processing apparatus 10 includes a log processing means generally indicated as 11 mounted above a chip and bark collection means generally indicated as 12.

The log processing means 11 includes a wood processing cylinder 13 that is operatively connected to a motor in motor housing 40. The log processing means 11 also includes a log guiding and rotating means 20 comprising a roller drive shaft 57 which is journaled for rotation within the bearings 55 and 56. A plurality of rollers 59 comprising toothed wheels are attached at their centers to the roller drive shaft 57 in spaced apart relation from one another between the bearings 55 and 56. The toothed circumferential edges of the rollers 59 extend to a point closely adjacent to the surface of the wood processing cylinder 13, preferably within one inch. The entire log rotation and guiding means can be raised or lowered by means of a hydraulic cylinder 67. A log processing apparatus in which the present invention can be used is described in U.S. Pat. No. 4,444,234 which is hereby incorporated by reference. It will be understood that other roller means, such as a drum having protruding spikes or other projections, can be substituted for the toothed wheels 59.

Figure 2:
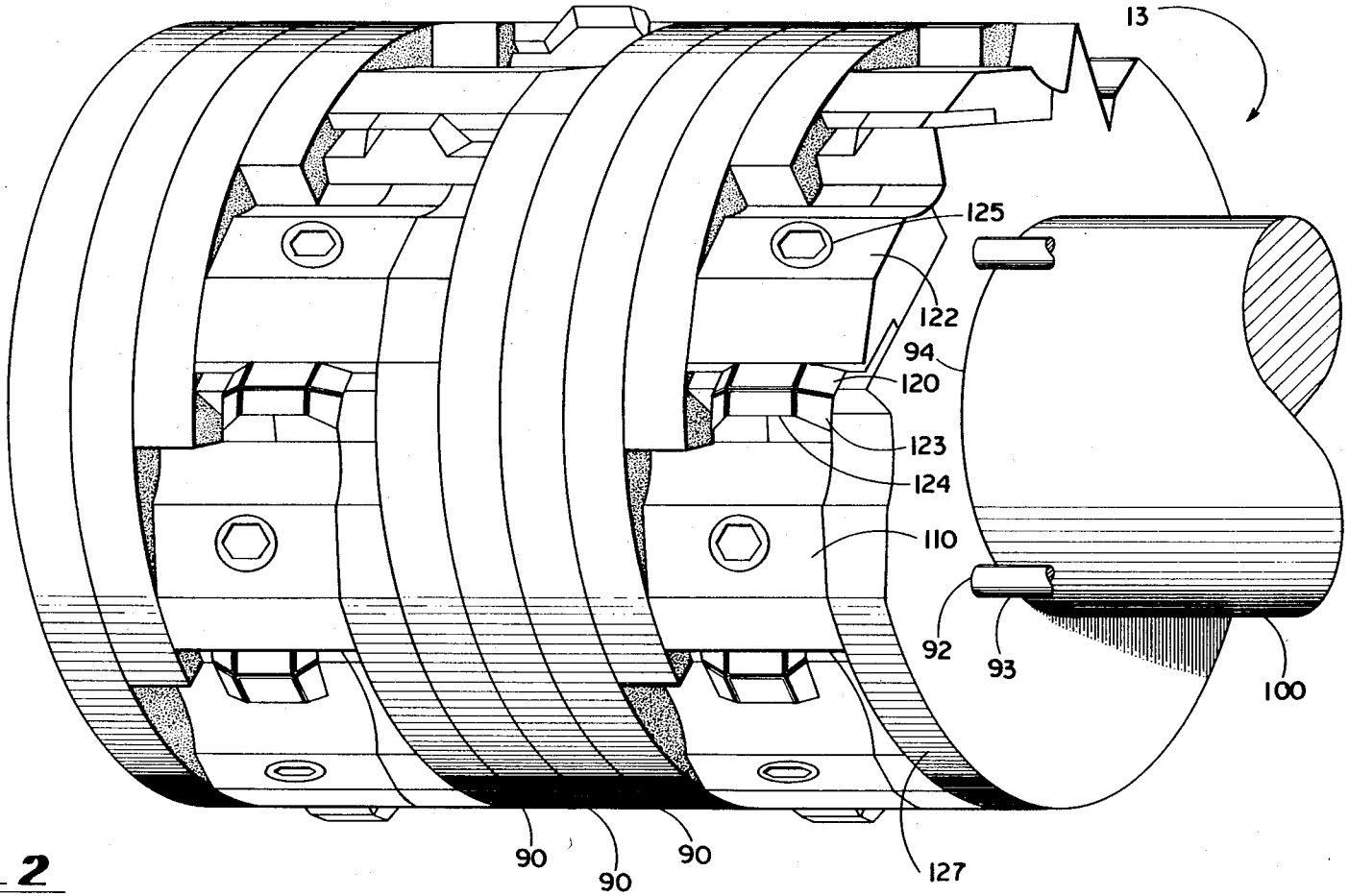
FIG. 2 is a perspective view of the wood processing cylinder shown in FIG. 1, broken away at the right end.

The wood processing cylinder 13 is shown in FIG. 2. the cylinder 13 is comprised of a plurality of knife holding discs 90. A cutter assembly 110 is mounted on each knife holding disc 90. The discs 90 are mounted on a central drive shaft 100 through center holes 94 defined on each disc, and are held in position on the drive shaft 100 by four smaller secondary shafts 93 which pass through holes 92 in each disc arranged around the center hole 94. The discs 90 are mounted on the shaft 100 in such a way that the cutter assemblies 110 form an overall helical pattern on the periphery of the wood processing cylinder (not shown).

FIG. 3 shows a perspective view of a knife holding disc 90. The cutter assembly 110 is mounted in a knife mounting recess 118 on the periphery of the knife holding disc 90. The recess 118 defines a bottom surface 132 and a back surface 131. A gullet block 116 is positioned on the bottom surface 132 of the knife mounting recess 118 and also abuts the back surface 131 of the recess. The outwardly extending end of the gullet block 116 is tapered outwardly from the back surface 131 to the top of the gullet block forming a gullet 117 under the outer extending end of cutter assembly 110. The cutter assembly 110 is held in position by machine screws 119, the heads of which are recessed in the gullet block 116 and the ends of which are threadedly engaged in the knife holding disc 90. A knife 120 rests upon the gullet block 116 and is clamped in place thereon by a knife clamp 122. The knife 120 is formed by bending downwardly side portions of a rectangular plate to form wings 123. The plate forming the knife 120 is then sharpened at the upper edge to form a primary cutting edge 124 and two wing cutting edges 123 as shown in FIG. 4. The shape of the knife provided cuts a properly shaped chip suitable for further processing. A machine screw 125 extends through the knife clamp 122 into a tapped opening 121 in the gullet block 116 to clamp the knife 120 firmly in position.

In addition to the knife holding recess 118, the knife holding disc 90 defines a rear recess 128 located immediately behind the cutter assembly 110. The knife holding disc 90 also defines a front recess 130 located immediately in front of the cutter assembly 110. The recesses 118, 128 and 130 are all cut-outs of the entire width of the material of the disc 90.

Figure 5:
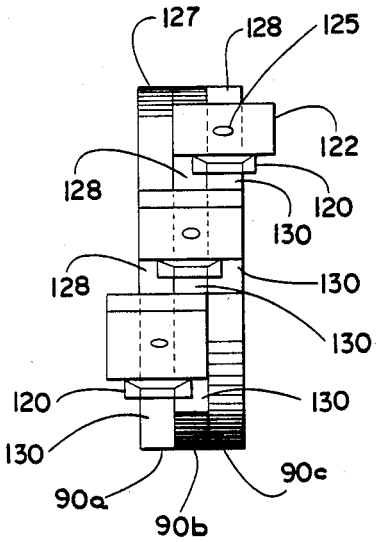
FIG. 5 is a side view of a part of the wood processing cylinder of FIG. 1.

As best shown in FIG. 5, the sharpened end of the knife 120 extends slightly beyond the outer circumferential surface of the knife holding disc 90. In addition, the wings 123 of knife 120 extend beyond the sides of knife holding disc 90. Referring to FIG. 3, a gullet 117 is formed by the lower protruding surface of the knife 120, the gullet block 116 and the front disc recess 130 in the knife holding disc. Chips or bark cut away from a log by the knife 120 are collected in the gullet 117 and front recess 130 until they are dropped from the gullet into the chip and bark collection means 12 described above.

In addition, the front recess 130 and the rear recess 128 provide a space for the overlapping cutter assembly on the adjacent knife holding disc 90. This is best shown in FIG. 5 where three knife holding discs 90*a*, 90*b* and 90*c* are shown adjacent to each other. The discs 90 are positioned relative to each other so that the cutting paths of knives 120 overlap. For example, the knife 120 on knife holding disc 90*b* overlaps into rear recess 128 on knife holding disc 90*a* and, on the other side, overlaps into the front recess 130 of knife holding disc 90*c*. In addition, as shown in FIG. 3, the knife wings 123 of knife 120 extend beyond the circumference of disc 90. When a plurality of discs are stacked together to form the wood processing cylinder 13, the cutting assemblies 110 attached to discs 90 are arranged in a helical manner (see FIG. 1). In addition, the cutting paths of each knife 120 overlaps the cutting path of the adjacent knife 120.

Figure 6:
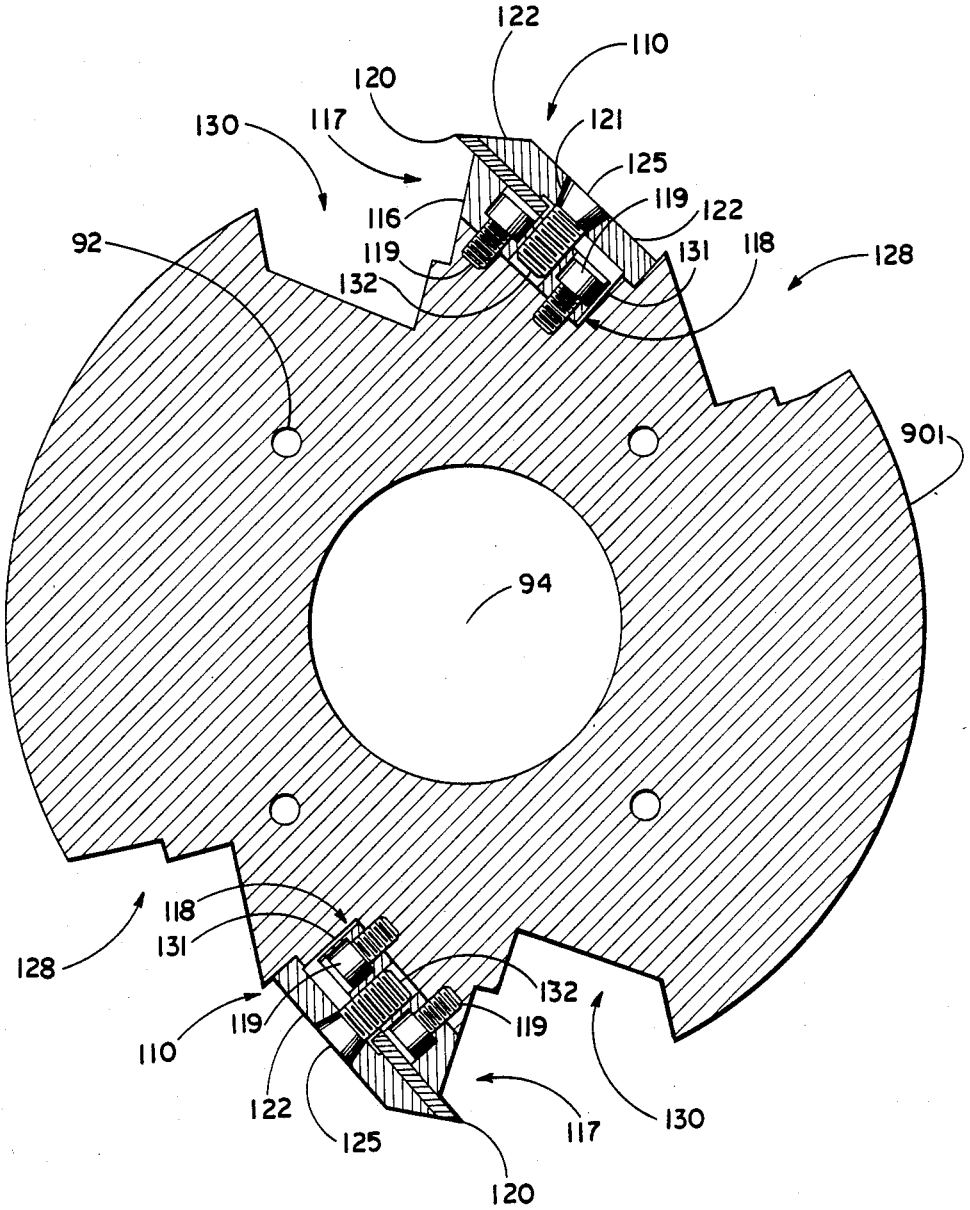
FIG. 6 is a side cross-sectional view of a cutting disc with two knives utilized in the cutter assembly of FIG. 1.

In FIG. 6 is shown a second embodiment of the present invention assemblies 110 mounted in the periphery of the disc 90. The cutting assemblies 110 are mounted directly opposite each other in the disc 90 in knife holding recesses 118 in a manner similar to the single knife holding disc 90. The edges of wings 123 of cutting assemblies 110 extend slightly beyond the circumference of disc 90 (not shown). The disc 90 has a rear disc recess 128 directly behind the cutting assemblies 110 and a front disc recess 130 directly in front of cutting assemblies 110. These recesses perform the same function as the front and rear disc recesses in the single knife holding disc 90 as shown in FIG. 3. The front disc recess 130 collect chips and bark as the knife 120 cuts into a log. The chips and bark fell out of the recess 130 as the disc 90 rotates. In addition, the front and rear recesses 130 and 128 provide a space into which the knives 120 on the adjacent disc can overlap. As with the single knife holding disc 90, the double disc holding disc 90 can be stacked together in order to form a wood processing cylinder with wood cutting assemblies 110 arranged in a helical manner.

Operation of the embodiments of the invention shown in FIGS. 1–6 will be substantially apparent from the abovedescription of the apparatus 10. Referring now to FIG. 1, a log is deposited into a cradle formed between the toothed wheels 59 and the wood processing cylinder 13. The motor housed in motor housing 40 is started thereby rotating the wood processing cylinder 13 and the toothed wheels 59 in a clockwise direction. The rotation of the toothed wheels 59, causes the log to rotate at a controlled speed in a clockwise direction. Rotation of the wood processing cylinder 13 causes the knives 120 to cut away pieces of the bark from the exterior of the log 72. If the log is rotating sufficiently slowly, the overlapping axial positions of the cutter assemblies 110, as shown in FIG. 1, will result in the bark being removed from the entire surface of the log in one revolution of the log. Furthermore, continuous rotation of the log by the toothed wheels 59 results in material being removed evenly from the outer surface of the log and prevents the cutters from cutting deep into the log from one position around its circumference.

Once the bark is removed, chips of the now exposed wood of the log will be guided into the chip collection area 12. Action of the knives 120 continues evenly around the surface of the log, so that as material is removed from the log, the log becomes rounded. Cutting can continue until the log is perfectly round and has been reduced in diameter to any desired size. It will be understood that the log can be completely consumed by chipping by simply continuing to operate the apparatus. If processing by the apparatus 10 is completed when the log is still in log form, the log is discharged by lowering the toothed wheels 59 causing the log to be discharged.

It will further be understood that the continuous rotation of the log by the toothed wheels 59 results in the knives 120 consistently traveling only a short distance through the outer surface of the log. Because the diameter of the cutting cylinder 13 in the wood processing apparatus of the present invention is much smaller than the cutting cylinders of the prior art, the optimum rim speed of the cutting assemblies 110 for producing chips occurs at a higher RPM than that of the cutting assemblies in the prior art. Since the same number or more knives may be mounted on the cutting cylinder 13, than on a conventional drum, the production rate at optimum knife speed thus will be higher. Furthermore, it has been found that a motor providing less than fifty horsepower is required to operate an apparatus as shown in FIG. 1 in which the wood processing cylinder 13 with single knife discs 90 is about 12 inches in diameter. For a wood processing cylinder with two knife assemblies per discs 90, the diameter of the cylinder 13 is optimally approximately about 18 inches. The diameter of the machine also results in a lower noise level and longer life for the knives before they require resharpening. In addition, when a disc is damaged and needs to be replaced, the machine operator simply removes the disc and replaces the disc with a new disc with a functioning knife or knives. The disc and any defective knife may be repaired at a later time resulting in a minimum down time for the machine.

Any size log may be deposited between the toothed wheels and the wood processing cylinder 13. It will be noted that in the operation just described, prior art processes that have been accomplished by separate machines, namely debarking, rounding, sizing and chipping, are all accomplished efficiently by one apparatus embodying the present invention. A reversible variable speed drive can be provided as the variable speed drive 65, and the toothed wheels 59 can be rotated in a clockwise direction to alternately operate the device as a rapid rotary chipper. However, this causes the knife cuts to be longer and utilizes more energy.

By using the wood processing apparatus of the present invention as a log chipper wherein the word processing cylindercylinder 13 is comprised of the plurality of wood chipping discs 90, the diameter of the overall cylinder 13 may be reduced thereby increasing the RPM of the device for an optimum rim speed of the individual knives 120 as the cylinder 13 rotates during operation of the wood processing apparatus 10. Those skilled in the art will understand that the speed of the knives through the wood should be optimized to give the desired fracturing effect for producing properly shaped wood chips. The diameter of the overall cylinder can be reduced because each disc is solid except for the recess holding the knife assembly and the shaft opening. When the discs are mounted on the shaft in the manner described herein, a cylinder is formed which is essentially solid providing much greater strength than the hollow cylinder disclosed in the prior art. It has been determined that by decreasing the cylinder 13 diameter from 24 inches to 18 inches as shown in the present invention, the production rate of wood chips can be doubled.

Figure 7:
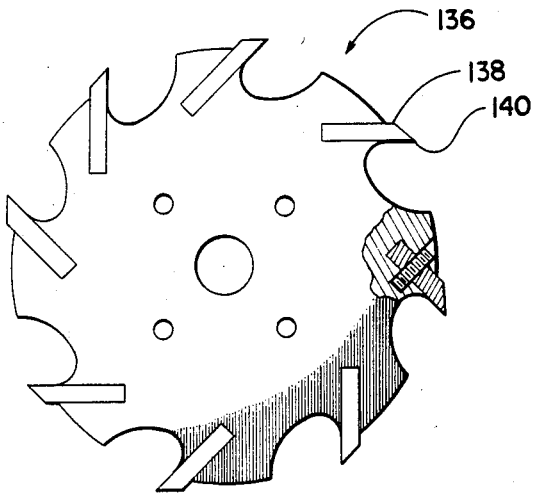
FIG. 7 is a side view of the flaker disc of the present invention.
Figure 8:
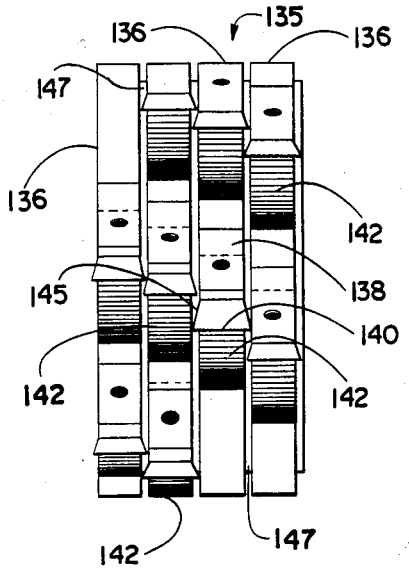
FIG. 8 is a front view of the wood flaking head.

Another embodiment of the log processing apparatus of the present invention is shown in FIGS. 7 and 8. In this embodiment, the log processing apparatus is designed to produce very thin flakes of wood for use in the press board industry. A side view of a knife holding disc 136 is shown in FIG. 7. The knife holding disc 136, shown in FIG. 7, has 8 knives 138 mounted in the disc. In the preferred embodiment of the present invention, the knife holding disc 136 has between 4 and 8 knives 138 mounted on the disc 136. The sharp edge 140 of each knife 138 extends beyond the circumference of the disc 136. In front of the knife 136 is a front gullet 142 that has a curved shape. The curved shape of the front gullet 142 holds the flake as it is being cut from the log. As the flake is being cut from the log, the curve of front gullet 142 will cause the flake to fracture and fall out of the front gullet 142.

Referring now to FIG. 8, which shows a front view of the plurality of discs 136 forming wood flaking cylinder 135, the sides of knife edge 140 extend slightly beyond the sides of knife holding disc 136. Each disc 136 is separated by a spacer disc 147. The width of the spacer disc 146 is equal to the distance that the side wing 145 of knife 140 extends beyond the sides of knife holding disc 136. Thus, when knife holding discs 136 and spacer discs 145 are stacked in an alternating manner as shown in FIG. 8, the knives 138 are arranged in a helical manner so that the cutting path of the knives 138 overlap each other.

Figure 9:
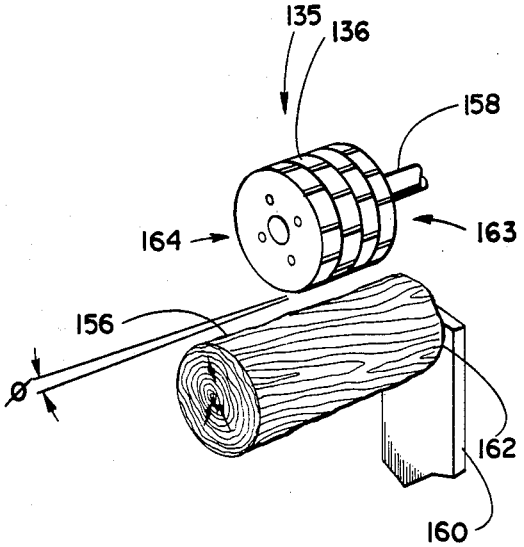
FIG. 9 is a diagrammatic perspective view of the wood processing apparatus designed for production of wood flakes with one flaking head as shown in FIG. 8.

Referring now to FIG. 9, the wood flaking cylinder 135 of the present invention is mounted on the end of a shaft 158. The other end of the shaft 158 is operatively connected to a motor 155. The shaft is mounted on a vertically movable carriage (not shown) so that the wood flaking cylinder 135 can be selectably moved up or down. A log stop 160 is provided to position the log under the wood flaking cylinder 135 so that the end of the log 162 is substantially parallel with the back end 163 of the wood flaking cylinder 135. In the preferred embodiment of the present invention, the wood flaking cylinder is tilted so that the front end 164 of the wood flaking cylinder is positioned slightly higher than the back end 163 of the wood flaking cylinder. In the preferred embodiment of the flaking apparatus, the flaking cylinder is tilted at an angle $\phi$ of approximately 2°. Tilting the flaking cylinder in this manner provides clearance for the front end 164 of the flaking cylinder as it cuts through the log. In operations, the carriage is moved downwardly at a controlled speed, so that the knives penetrate only slightly, removing thin flakes preferably 0.005 inches to 0.025 inches thick. The thickness is gauged by the speed of downward movement, and the log never touches the surface of the assembled discs. Thus, the cylinder avoids vibration caused by the log contact, which wears the cutting edges more rapidly.

Figure 10:
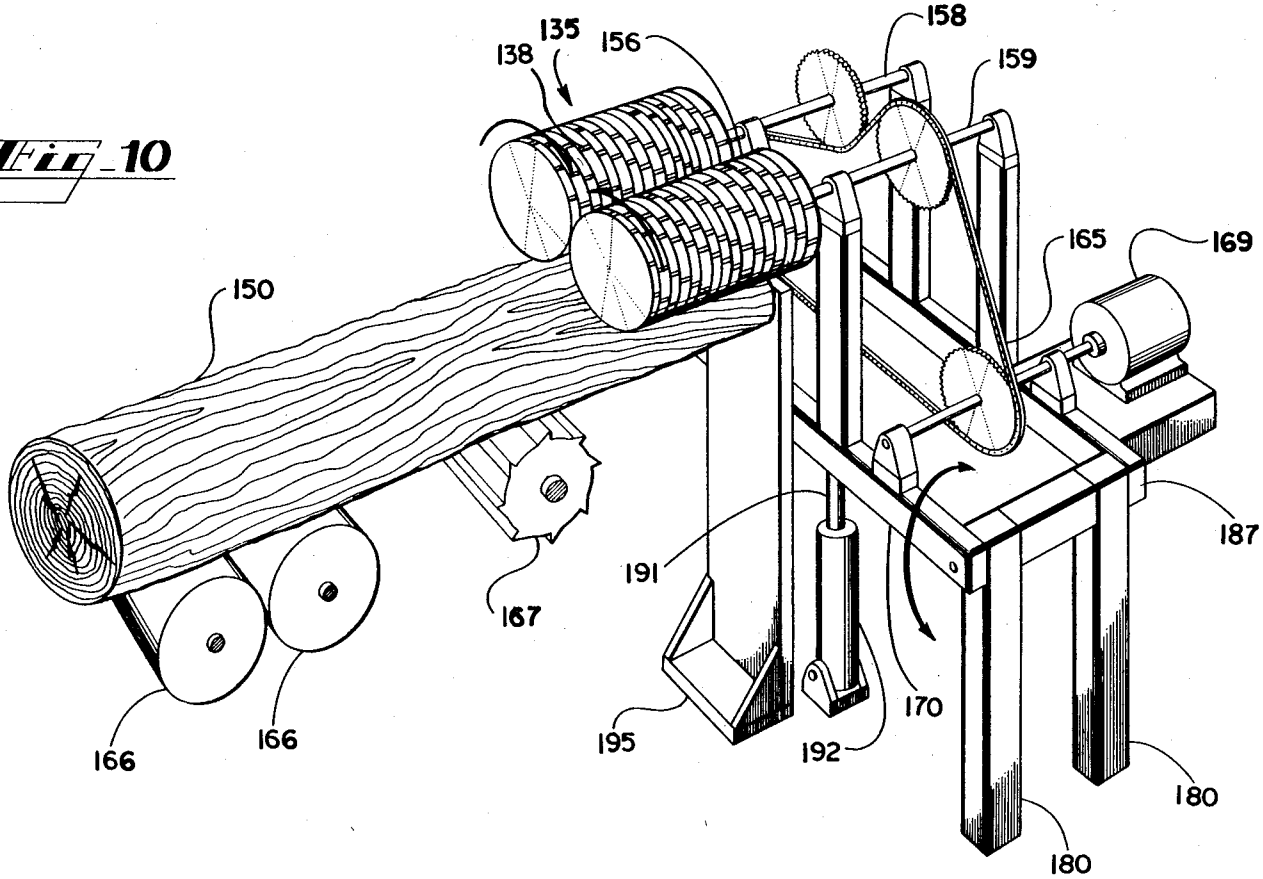
FIG. 10 is a diagrammatic perspective view of the wood processing apparatus designed for production of wood flakes with two wood flaking heads.

In another embodiment of the present invention, a second wood flaking cylinder 156, identical to the first wood flaking cylinder 135, is mounted on shaft 159 next to the first wood flaker 135 as shown in FIG. 10. The shafts 159 and 158 are operatively connected to motor 169 by a chain 165. The frame 170 holding the two wood flaking cylinders is pivotally attached at 187 to support posts 180. The wood flaking cylinders 156 and 135 can thus be lowered by retracting rod 191 into hydraulic cylinder 192.

In the preferred orientation of this embodiment, the second wood flaker 156 is positioned slightly above the first wood flaking cylinder 135. In operation, both cylinders are positioned above a log 150. The log 150 is laid horizontally on rollers 166 and is urged under wood flaking cylinders 135 and 156 by a drive wheel 167 until the log abuts against log stop 195.

Looking at the wood flaking cylinders 135 and 156 from the side where the log 150 is engaged, the cylinders 135 and 156 are rotating in opposite directions so that the knives 138 are rotating away from each other. In this way, as the rotating cylinders are moved toward the log at a controlled speed, the wood flakes are cut from the log 150 by knives 138 and are thrown away from the cutting area. In addition, any dirt or debris that may be lodged in the bark on the surface of the log is thrown clear of the cutting area. As a result the knives in the wood flaking apparatus of the present invention remain sharp much longer than knives in flaking apparatus of prior art. After the wood flaking cylinders 135 and 159 have cut through the log 150, the rod 191 is extended from cylinder 192 causing the wood flaking cylinders 135 and 156 to be raised. The log 150 is then urged toward the log stop 195 by drive wheel 167 until the log abuts against the log stop 195. The wood flaking cylinders 135 and 156 are then lowered onto log 150.

From the foregoing, it will be understood by those of ordinary skill in the art that the present invention provides significant improvements and advantages over prior apparatus and methods for debarking, rounding, sizing, chipping and flaking logs. An apparatus embodying the present invention does not merely combine known techniques for debarking with those for rounding, sizing and chipping, but provides a new apparatus which accomplishes all necessary functions prior to further processing of a log in, for example, veneer mill, in a single operation. In addition, a second embodiment of the present invention provides an apparatus that will reduce a log to very thin flakes that are suitable for production of press board. Thus, the present invention results in significant time savings as well as energy efficiencies. Flexibility is also provided in that no maximum diameter or minimum length is placed on logs capable of being processed in an apparatus embodying the present invention.

While this invention has been described in detail with particular reference to preferred embodiments thereof, it will be understood that variations and modifications can be effected within the spirit and scope of the invention as described hereinbefore and as defined in the appended claims.

I claim:

1. A cylindrical cutter assembly for use in a wood processing apparatus comprising:

a plurality of discs mounted on a central shaft; a first of said discs including at least a first cutter mounted on the periphery of said disc and a rear indentation behind said first cutter large enough to allow a second cutter attached to a second adjacent disc to overlap said first disc; and a front indentation in said first disc in front of said first cutter to allow a third cutter attached to a third adjacent disc to overlap said first disc.

2. A wood processing apparatus comprising:

a plurality of discs mounted on a horizontal longitudinal axis and including a plurality of axially overlapping cutters arrayed along the periphery of said discs and extending outwardly from said disc periphery;

means for rotating said discs about said longitudinal axis, and roller means positioned beside said discs such that the periphery of said roller means is positioned closely adjacent to the periphery of said discs, said roller periphery and said disc periphery supporting said log and defining a log-receiving cradle therebetween.

3. The apparatus of claim 2 wherein each of said plurality of discs comprises a first disc side and a second disc side perpendicular to said longitudinal axis;

each said disc defining at least one recess in the periphery of said disc; and one of said cutters being held in said recess, said cutter including a cutting edge extending beyond said first side and said second side of said disc.

4. The apparatus of claim 3 wherein the recess in each said disc comprises:

a rear indentation behind said cutter large enough to allow a second cutter attached to a first adjacent disc to overlap said disc, a front indentation in front of said cutter to allow a third cutter attached to a second adjacent disc to overlap said disc, and wherein the cutters on each said disc are arrayed helically about the periphery of said plurality of discs.

5. The apparatus of claim 1 wherein said cutters comprise a central linear cutting edge having the same width as said disc, and a pair of wing cutting edges extending at an obtuse angle from the ends of said central cutting edge.

6. An apparatus for making flakes from a log comprising:

a flaking head including a flaking cylinder, said cylinder comprising a plurality of discs and including a plurality of axially overlapping knives arrayed along the periphery of said discs and extending outwardly from said disc periphery;

means for rotating said discs about their longitudinal axes, and means for guiding said flaking cylinder toward said log at a controlled speed.

7. The apparatus of claim 6 wherein each of said plurality of discs comprises:

a first disc side and a second disc side perpendicular to said longitudinal axis, each said disc having at least one recess in the periphery of said disc, and a flaking knife held in said recess, said flaking knife having a linear cutting edge parallel to said longitudinal axis, said cutting edge extending beyond said disc sides; and further comprising:

a spacer disc between each adjacent pair of said disc, said spacer disc having a thickness equal to the distance said flaking knife cutting edge extends beyond said disc sides.

8. The apparatus of claim 6 further comprising a means for feeding and holding said log in a position parallel and adjacent to said flaking head.

9. The apparatus of claim 6 wherein said flaking head further comprises a first wood flaking cylinder and a second wood flaking cylinder, each of said cylinders comprising a plurality of discs and including a plurality of knives arrayed along the periphery of said discs and extending outwardly from said disc periphery, said first wood flaking cylinder mounted substantially adjacent to said second wood flaking cylinder.

10. The apparatus of claim 9 wherein said first flaking cylinder and said second flaking cylinder are mounted on a horizontal longitudinal axis.

11. The apparatus of claim 9 wherein said flaking head is guided toward said log at a speed such that the periphery of the discs never contacts said log.

12. The apparatus of claim 9 wherein said wood flaking cylinders rotate in opposite directions away from said log as said cylinders contact said log so that said flakes are thrown outwardly from said log.

13. The apparatus of claim 6 further comprising a means for feeding and holding said log is a positin parallel and adjacent to said flaking head.

14. A method of producing flakes from a wooden member comprising the steps of:

holding a wooden member in a position under a flaking head, said flaking head including a rotating wood flaking cylinder, said cylinder comprised of a plurality of discs and including a plurality of axially overlapping knives arrayed along the periphery of said discs and extending outwardly from said disc periphery; and guiding said flaking head toward said log at a controlled speed so that said periphery of said disc does not touch said log.

15. The method of claim 14 wherein said flaking head includes a first wood flaking cylinder rotating in a first direction and a second wood flaking cylinder rotating in a second and opposite direction, each of said cylinders comprising a plurality of discs and including a plurality of knives arrayed along the periphery of said discs and extending outwardly from said disc periphery; said first wood flaking cylinder mounted substantially adjacent to said second wood flaking cylinder.

* * * * *